US009021747B2

(12) United States Patent
Lenney et al.

(10) Patent No.: US 9,021,747 B2
(45) Date of Patent: May 5, 2015

(54) CORRUGATED MESH GUTTER LEAF PRECLUSION SYSTEM

(75) Inventors: Robert C. Lenney, Newcastle, CA (US); John R. Lewis, Modesto, CA (US)

(73) Assignee: Gutterglove, Inc., Rocklin, CA (US)

( * ) Notice: Subject to any disclaimer, the term of this patent is extended or adjusted under 35 U.S.C. 154(b) by 711 days.

(21) Appl. No.: 12/807,394

(22) Filed: Sep. 3, 2010

(65) Prior Publication Data

US 2011/0056145 A1 Mar. 10, 2011

Related U.S. Application Data

(60) Provisional application No. 61/275,943, filed on Sep. 4, 2009, provisional application No. 61/277,441, filed on Sep. 23, 2009.

(51) Int. Cl.
*E04D 13/076* (2006.01)

(52) U.S. Cl.
CPC ..... *E04D 13/076* (2013.01)

(58) Field of Classification Search
CPC ..... E04D 13/076
USPC ..... 52/12; 210/163, 474, 499
See application file for complete search history.

(56) References Cited

U.S. PATENT DOCUMENTS

| | | | | | |
|---|---|---|---|---|---|
| 546,042 | A | * | 9/1895 | Van Horn | 52/12 |
| 1,732,058 | A | | 10/1929 | Martini | |
| 2,229,381 | A | | 1/1941 | Grow | |
| 2,288,121 | A | | 6/1942 | Sandmeyer | |
| 2,583,422 | A | | 1/1952 | Haddon | |
| 2,674,961 | A | * | 4/1954 | Lake | 52/12 |
| 3,691,343 | A | | 9/1972 | Norman | |
| 3,950,951 | A | * | 4/1976 | Zukauskas | 405/119 |
| 4,308,696 | A | | 1/1982 | Schroeder | |
| 4,435,466 | A | | 3/1984 | Kuhnel et al. | |
| 4,646,488 | A | | 3/1987 | Burns | |
| 4,745,710 | A | * | 5/1988 | Davis | 52/12 |
| 4,755,229 | A | | 7/1988 | Armanini | |
| 4,769,526 | A | | 9/1988 | Taouil | |
| 4,827,686 | A | | 5/1989 | Stamper et al. | |
| 4,949,514 | A | | 8/1990 | Weller | |
| 4,959,932 | A | * | 10/1990 | Pfeifer | 52/12 |
| 5,010,696 | A | | 4/1991 | Knittel | |
| 5,044,581 | A | | 9/1991 | Dressler | |
| 5,107,635 | A | | 4/1992 | Carpenter | |
| 5,127,200 | A | | 7/1992 | Doran | |

(Continued)

FOREIGN PATENT DOCUMENTS

WO WO9953157 A1 10/1999

*Primary Examiner* — Andrew J Triggs
(74) *Attorney, Agent, or Firm* — Secure Patent Strategies; Glen L. Gross

(57) ABSTRACT

Corrugated fine mesh material is configured to be located overlying a gutter. The fine mesh material has an upper edge opposite a lower edge with the upper edge configured to fit beneath shingles on a roof adjacent the gutter. The lower edge is configured to be held to a lip at a forward edge of the gutter. The corrugations add strength to the material and collect water at troughs thereof where the collected water more readily forms droplets that fall down into the gutter. A lower strip is preferably provided to hold the lower edge of the mesh to a lip of the gutter. An upper strip is optionally provided which includes a tab which can fit beneath shingles to the roof. A barrier such as a bead of caulk can optionally be coupled to an underside of the corrugated mesh to further encourage water droplets to fall.

23 Claims, 4 Drawing Sheets

(56) References Cited

U.S. PATENT DOCUMENTS

| | | | | |
|---|---|---|---|---|
| 5,261,195 | A | 11/1993 | Buckenmaier | |
| 5,315,090 | A | 5/1994 | Lowenthal | |
| 5,391,858 | A | 2/1995 | Tourangeau | |
| 5,398,464 | A | 3/1995 | Jacobs | |
| 5,406,754 | A | 4/1995 | Cosby | |
| 5,459,965 | A * | 10/1995 | Meckstroth | 52/12 |
| 5,558,705 | A | 9/1996 | Keemer et al. | |
| 5,617,678 | A | 4/1997 | Morandin | |
| 5,640,809 | A * | 6/1997 | Iannelli | 52/12 |
| 5,729,931 | A | 3/1998 | Wade | |
| 5,759,255 | A | 6/1998 | Venturini et al. | |
| 5,878,533 | A | 3/1999 | Swanfeld | |
| 6,134,843 | A | 10/2000 | Tregear | |
| 6,194,049 | B1 | 2/2001 | Bindschedler-Galli et al. | |
| 6,194,519 | B1 | 2/2001 | Blalock et al. | |
| 6,205,715 | B1 | 3/2001 | Rex | |
| 6,225,600 | B1 | 5/2001 | Burris | |
| 6,341,462 | B2 | 1/2002 | Kiilk et al. | |
| 6,598,352 | B2 | 7/2003 | Higginbotham | |
| 6,607,781 | B2 | 8/2003 | Joedicke | |
| 6,700,098 | B1 | 3/2004 | Wyatt et al. | |
| 6,708,452 | B1 | 3/2004 | Tenute | |
| 6,759,630 | B1 | 7/2004 | Tenute | |
| 6,933,007 | B2 | 8/2005 | Fensel et al. | |
| 6,942,419 | B2 | 9/2005 | Knak | |
| 6,951,077 | B1 | 10/2005 | Higginbotham | |
| 6,959,512 | B2 | 11/2005 | Cobb | |
| 7,104,012 | B1 | 9/2006 | Bayram | |
| 7,174,688 | B2 | 2/2007 | Higginbotham | |
| 7,191,564 | B2 | 3/2007 | Higginbotham | |
| 7,241,500 | B2 | 7/2007 | Shiao et al. | |
| 7,310,912 | B2 | 12/2007 | Lenney | |
| 7,448,167 | B2 | 11/2008 | Bachman | |
| 7,624,541 | B2 | 12/2009 | Gentry | |
| 7,913,458 | B2 * | 3/2011 | Higginbotham | 52/12 |
| 7,975,435 | B2 | 7/2011 | Lenney | |
| 8,033,058 | B2 | 10/2011 | Block | |
| 8,079,183 | B2 | 12/2011 | Lenney | |
| 8,479,454 | B2 * | 7/2013 | Lenney et al. | 52/12 |
| 8,572,899 | B1 * | 11/2013 | Pearce et al. | 52/12 |
| 2003/0046876 | A1 | 3/2003 | Higginbotham | |
| 2003/0198736 | A1 | 10/2003 | Fensel et al. | |
| 2005/0072114 | A1 | 4/2005 | Shiao et al. | |
| 2005/0279036 | A1 | 12/2005 | Brochu | |
| 2006/0037252 | A1 | 2/2006 | Gosse et al. | |
| 2006/0117670 | A1 | 6/2006 | Tsioris | |
| 2006/0179723 | A1 * | 8/2006 | Robins | 52/11 |
| 2006/0196124 | A1 | 9/2006 | Bachman | |
| 2006/0213129 | A1 | 9/2006 | Bachman | |
| 2006/0277831 | A1 | 12/2006 | Bachman | |
| 2006/0283096 | A1 | 12/2006 | Bachman | |
| 2007/0054129 | A1 | 3/2007 | Kalkanoglu et al. | |
| 2007/0065640 | A1 | 3/2007 | Joedicke | |
| 2007/0094939 | A1 | 5/2007 | Bachman | |
| 2007/0107323 | A1 | 5/2007 | Higginbotham | |
| 2007/0199276 | A1 | 8/2007 | Duque | |
| 2007/0218251 | A1 | 9/2007 | Jacobs | |
| 2007/0220814 | A1 * | 9/2007 | Faulks | 52/12 |
| 2007/0234647 | A1 | 10/2007 | Higginbotham | |
| 2007/0246449 | A1 | 10/2007 | Bachman | |
| 2008/0187708 | A1 | 8/2008 | Decker | |
| 2008/0248241 | A1 | 10/2008 | Kalkanoglu et al. | |
| 2009/0056234 | A1 | 3/2009 | Brochu | |
| 2009/0064628 | A1 | 3/2009 | Mellott et al. | |
| 2009/0300995 | A1 * | 12/2009 | Nikolopoulos | 52/12 |
| 2011/0067318 | A1 * | 3/2011 | Lenney et al. | 52/12 |
| 2011/0138698 | A1 | 6/2011 | Neumann | |
| 2011/0253611 | A1 | 10/2011 | Higginbotham | |
| 2012/0042579 | A1 | 2/2012 | McCoy | |
| 2013/0160377 | A1 * | 6/2013 | Sager | 52/12 |
| 2013/0160378 | A1 * | 6/2013 | Higginbotham | 52/12 |
| 2014/0013702 | A1 * | 1/2014 | Pearce et al. | 52/741.3 |
| 2014/0263001 | A1 * | 9/2014 | Higginbotham | 210/162 |

* cited by examiner

CORRUGATED MESH GUTTER LEAF PRECLUSION SYSTEM

CROSS-REFERENCE TO RELATED APPLICATIONS

This application claims benefit under Title 35, United States Code §119(e) of U.S. Provisional Application No. 61/275,943 filed on Sep. 4, 2009 and U.S. Provisional Application No. 61/277,441 filed on Sep. 23, 2009.

FIELD OF THE INVENTION

The following invention relates to debris preclusion systems for roof gutters, often referred to as gutter guards. More particularly, this invention relates to filter screen mesh type gutter guards which have a fine mesh of material to preclude leaves and other debris from falling into the gutter, while allowing water to filter through the mesh and into the gutter.

BACKGROUND OF THE INVENTION

Gutters are commonly used along eaves at a lower end of a sloping roof to catch water running off of the roof and channel that water into particular areas rather than allowing the water to merely fall from the roof. Such gutters often become clogged, especially when trees are located nearby and shed leaves which can end up in the gutters. Accordingly, leaf preclusion systems, often called "gutter guards," are known in the prior art for attachment over the gutters. Such gutter guards serve the basic purpose of allowing water to pass into the gutter but precluding leaves and other debris from passing into the gutter.

One type of gutter guard utilizes a filter layer which has small openings therein which allow water to pass through but which preclude leaves and other debris from passing therethrough. One example of such a prior art mesh based leaf preclusion system is in U.S. Pat. No. 7,310,912, incorporated herein by reference in its entirety.

The phenomena of water tension and molecular cohesion tend to cause water to not want to pass through such mesh layers, but rather to cling to the mesh. These forces thus frustrate the ability of mesh based gutter guards to allow water to pass through the mesh while precluding debris from passing into the gutter. With known prior art mesh based gutter guards, commonly an underlying support is provided beneath the mesh. This underlying support serves two purposes. First, it keeps the mesh generally planar overlying the gutter. Second, it contacts an underside of the mesh providing a path along which water can flow while adhering to the underlying support. Holes in the underlying support then allow water to drop through in larger drops where the weight of the drops is sufficient that the surface tension and adhesion forces cannot resist such dropping.

While effective, such mesh based gutter guards with underlying supports require a two part structure to operate effectively. These two parts increase the cost to manufacture the separate parts as well as adding additional assembly steps to produce the final gutter guard product. Many consumers benefit from having a simpler and potentially lower cost alternative which can still function effectively to preclude leaves and other debris from collecting within a gutter. With this invention such a leaf preclusion system is provided with a simple single part construction which can still effectively filter leaves and other debris out while allowing water to pass into the gutter and have the structural support needed to maintain its position overlying the gutter.

SUMMARY OF THE INVENTION

With this invention, a leaf preclusion system is provided for a gutter which includes a filter layer, such as formed of stainless steel mesh, which filters out debris (e.g. leaves) while allowing water to pass therethrough. Uniquely, no underlying support is required beneath the filter member. The filter member is itself imbued with properties of sufficient stiffness and the ability to overcome water droplet adhesion characteristics without requiring an underlying support. Strength is provided to the filter member by providing a corrugated form of either an undulating sinusoidal nature or a zig-zag toothed nature, or other cross-section. Such a cross-section for the mesh causes the mesh to have greater strength particularly in resisting bending. These corrugations extend perpendicular to a long axis of the gutter and parallel with a direction that water is migrating off of the roof. Thus, these corrugations greatly resist flexing along the gutter where the mesh would otherwise be most susceptible to bending.

When water runs off of the roof and lands on the corrugated mesh material, debris is kept from passing through the small openings in the mesh. Water does tend to adhere to this mesh but is drawn by gravity down into the troughs between crests in the corrugated mesh material. As the water is concentrated in these troughs, the water collects into drops sufficiently large that the weight of the water drops exceeds adhesion forces and surface tension forces so that the water drops.

To further enhance the channeling of the water down into the gutter, a lower strip is optionally provided which acts as a form of dam to stop the water if it migrates entirely to a lower end of each trough and diverts the water down into the gutter. This front strip of material, typically formed of a rigid or semi-rigid material such as aluminum, or a hydrocarbon polymeric plastic material can also provide a surface which can be used to fasten to a front lip of the gutter. In one form of the invention this strip can have a snapping clamp plate so that it can snap onto the front lip of the gutter so that fasteners are not required.

Beneficially, a bead of caulk material or other barrier can be bonded to the underside of the mesh along a line between (e.g. midway) upper and lower edges of the mesh. Such a barrier acts as an intermediate dam to cause water to collect and drop into the gutter.

An upper end of the filter material can merely be left bare and slip beneath shingles on the roof and above sheeting material underneath the shingles, and above any vapor barrier. Alternatively, an upper strip of rigid material, such as aluminum can be attached to the upper edge of the fine mesh filter material with a tab extending beneath the roof shingles and above underlying sheeting to ensure that water does not go underneath the leaf preclusion system, but rather the water remains on top of the tab and then on top of the mesh material.

Objects of the Invention

Accordingly, a primary object of the present invention is to provide a system for precluding debris from passing into a roof gutter while allowing water to pass into the roof gutter.

Another object of the present invention is to provide a gutter debris preclusion system which is easy to attach to a gutter.

Another object of the present invention is to provide a gutter debris preclusion system for a gutter which can accommodate gutters of different sizes and shapes as well as roof configurations of different materials, pitches and other geometric characteristics.

Another object of the present invention is to provide a gutter debris preclusion system which has a small number of parts and simple form to keep costs thereof reduced, while still effectively precluding passage of debris into the gutter and while effectively drawing water down into the gutter.

Another object of the present invention is to provide a debris preclusion system for a rain gutter which is sufficiently rigid to prevent collapse when encountering loads such as debris loads thereon.

Another object of the present invention is to provide a method for precluding the passage of debris into a gutter.

Other further objects of the present invention will become apparent from a careful reading of the included drawing figures, the claims and detailed description of the invention.

DESCRIPTION OF THE PREFERRED EMBODIMENT

Figure 1:
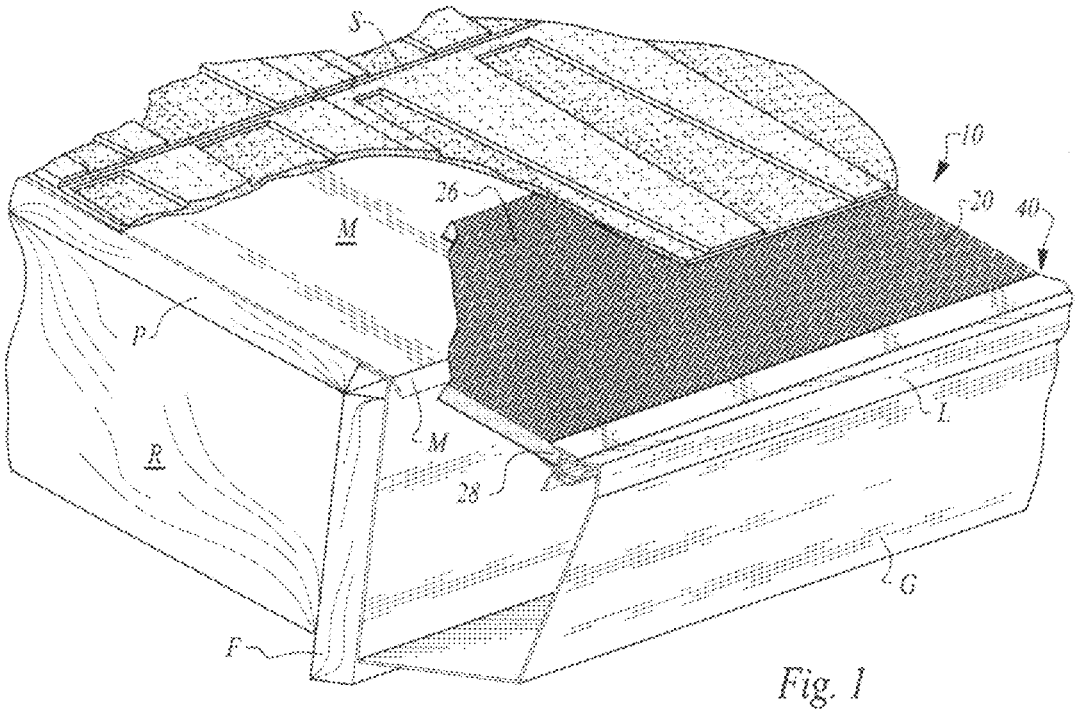
FIG. 1 is a perspective view of a section of a roof with a section of a gutter at a lower edge thereof and with the gutter debris preclusion system according to this invention mounted thereon, and with portions of shingles on the roof removed to reveal details of the system of this invention.

Referring to the drawings, wherein like reference numerals represent like parts throughout the various drawing figures, reference numeral 10 is directed to a debris preclusion system mountable overlying an opening on an upper portion of a gutter G and behind a lip L of the gutter G. The gutter G is typically attached to a fascia F along a lower edge of a roof R to capture water running off of shingles S supported over a moisture barrier M which is located upon plywood P or other sheeting material forming a structural surface of a roof R. The water runs down off of the shingles S and then down onto the debris preclusion system 10 overlying the gutter G. The system 10 is primarily formed of a fine mesh material so that the water can fall therethrough. The water will typically adhere to an underside of this corrugated mesh 20 (along arrow A of FIG. 2) and falling as a drop D of water down into the gutter G.

Figure 2:
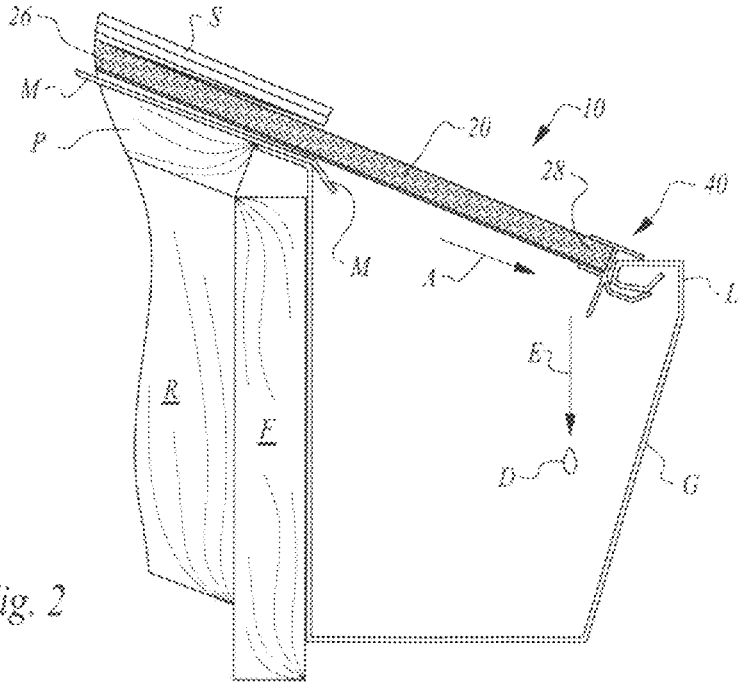
FIG. 2 is a side elevation view of that which is shown in FIG. 1.
Figure 3:
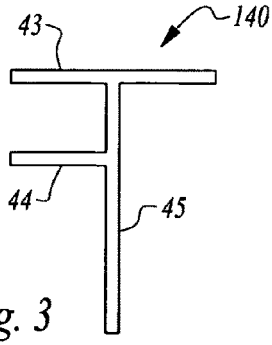
FIG. 3 is an end elevation view of a lower strip acting as a lower support for the debris preclusion system of this invention.
Figure 4:
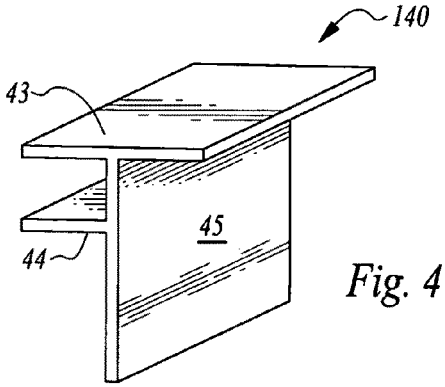
FIG. 4 is a perspective view of that which is shown in FIG. 3.
Figure 14:
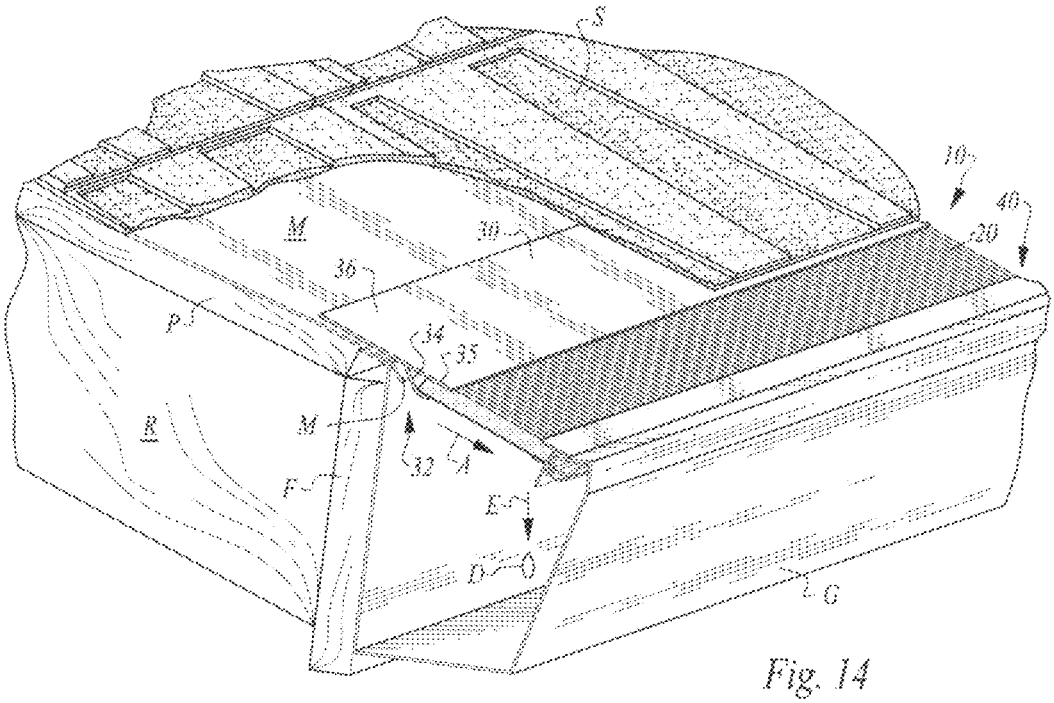
FIG. 14 is a perspective view similar to that which is shown in FIG. 1 but for an alternative embodiment debris preclusion system which also includes an upper strip with associated tab.
Figure 15:
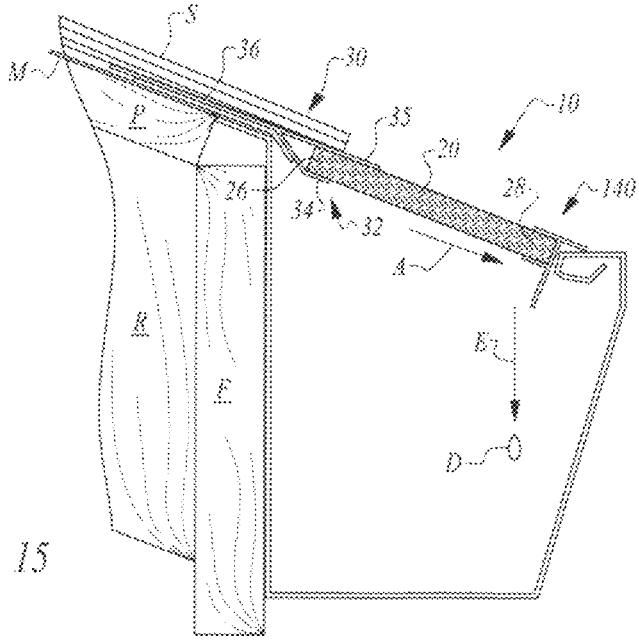
FIG. 15 is a side elevation view of that which is shown in FIG. 14.

In essence, and with particular reference to FIGS. 1 and 2, basic details of the debris preclusion system 10 are described, according to a simplest preferred embodiment. The system 10 includes the fine mesh material 20 which is corrugated to include a plurality of crests 22 (also referred to as ridges) opposite troughs 24 (also referred to as valleys). This corrugated mesh 20 has an upper edge 26 opposite a lower edge 28. The upper edge 26 in this simplest embodiment is oriented directly beneath the shingles S. Preferably, the lower edge 28 is held within a recess 42 in a lower strip 40. The lower strip 40 acts as a substantially rigid support which can rest upon or be coupled to the lip L of the gutter G. In a simplest form, an alternative lower strip 140 is configured as depicted in FIGS. 3 and 4. Most preferably, the lower strip 40 is configured with a clamp plate 46 which allows the lower strip 40 to snap onto the lip L of the gutter G. A bead of caulk 50 (FIGS. 16 and 17) can be optionally provided beneath the corrugated mesh material 20 to encourage water to drop off of this barrier (along arrow C of FIG. 16), before reaching the lower strip 40. In an alternative embodiment, an upper strip 30 can be provided adjacent the upper edge 26 of the corrugated mesh 20. The upper strip 30 includes a tab 36 which can reside beneath the shingles S and the roof R structural support (FIGS. 14 and 15).

More specifically, and with particular reference to FIGS. 1, 2 and 7-13, specific details of the corrugated fine mesh material 20 are described, according to a most preferred embodiment. The corrugated mesh 20 provides the function of allowing water to pass into the gutter G while precluding debris from passing into the gutter G. This corrugated mesh 20 is preferably formed as a woven screen of stainless steel wire or other wire/thread of suitable material. Important characteristics of the material forming the mesh include sufficiently high strength and inelasticity to function structurally, as well as resistance to corrosion in the gutter G environment. Furthermore, it is advantageous that material forming the corrugated mesh 20 can be readily bent sufficient to cause the material to be readily corrugated into one of a variety of different cross-sections, such as those meshes 20, 120, 122, 124, 126, 128 and 129 depicted in FIGS. 7-13 respectively, and hold that configuration after being so bent.

Most preferably, the wire forming the corrugated mesh 20 extends in a pattern with some threads extending parallel with the upper edge 26 of the overall corrugated mesh 20 and some of the wire/thread extending perpendicular to the upper edge 26 of the corrugated mesh 20. In such a configuration, the corrugation can occur to create the crests 20 and troughs 24 with only the threads which run parallel with the upper edge 26 needing to be bent. In such a configuration the corrugating of the fine mesh material forming the corrugated mesh 20 can more readily occur and this material forming the corrugated mesh can more readily maintain this corrugated configuration during installation and use. Hole size between adjacent wires/threads forming the corrugated mesh 20 can be selected according to various different design considerations including the debris present in the environment where the system is to be installed. Wire/thread diameter can also be adjusted to accommodate particular design characteristics desired for the overall system.

The corrugations in the corrugated mesh 20 preferably have an amplitude between crests 22 and troughs 24 between one-fourth and one-tenth of the length of the corrugated mesh 20 between the upper edge 26 and the lower edge 28 and similar to a width of the opening in the gutter G. This amplitude can be increased or decreased through experimentation or based on other design considerations to optimize performance of the system 10.

Preferably, these corrugations 20 are in a repeating pattern. This pattern is most preferably a zig-zag pattern, such as that depicted in FIG. 7. As an alternative, the pattern could be more sinusoidal with a curving crest 22 and curving trough 24. Other configurations can also be provided for the corrugated mesh 20 such as those depicted in FIGS. 8-13. Not only can these configurations be provided, but these configurations depicted in FIGS. 8-13 can be inverted and provided upside down. Furthermore, other configurations could be utilized which combine those depicted therein or be variations thereon. Selection of the corrugation pattern for the corrugated mesh 20 can be provided either to optimize function or to provide an aesthetic appearance that is desired by the user.

The amplitude of the corrugated mesh 20 is preferably constant throughout the corrugated mesh 20. Alternatively, it is conceivable that the corrugated mesh 20 could have its amplitude diminished or eliminated adjacent the upper edge 26 and lower edge 28. The upper edge 26 is preferably captured within a pocket 32 formed in the upper strip 30, if the upper strip 30 is provided. The lower edge 28 of the corrugated mesh 20 is preferably captured within a recess 42 in the lower strip 40, if the lower strip 40 is provided. The pocket 32 and recess 42 could be smaller in height if the corrugated mesh 20 is configured to taper to a lesser or zero amplitude at the upper edge 26 and lower edge 28. If desired, the corrugated mesh 20 could be configured to have a slightly looser weave that would then have this weave compressed adjacent the upper edge 26 and lower edge 28 when this amplitude is decreased, so that the overall corrugated mesh 20 would have a minimum of stress when having this amplitude change, and while still being corrugated and sufficiently tightly woven.

With particular reference to FIGS. 1-6, details of the lower strip 40 providing a preferred form of support for the lower edge 28 of the corrugated mesh 20 are described according to a most preferred embodiment. While the lower strip 40 or other lower support could be eliminated and the lower edge 28 of the corrugated mesh 20 could merely rest upon or be fastened to the gutter G, most preferably, the lower strip 40 is provided to facilitate such attachment of the lower edge 28 of the corrugated mesh 20 to the lip L of the gutter G.

Figure 5:
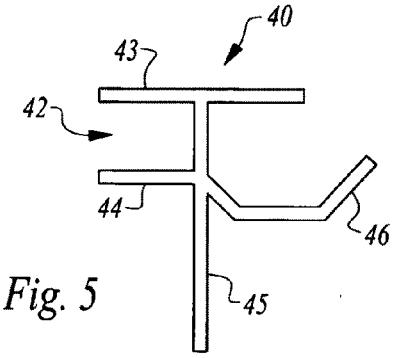
FIG. 5 is an end elevation view of an alternative embodiment of that which is shown in FIG. 3, featuring a clamp for securing portions of the system to a lip of a gutter.
Figure 6:
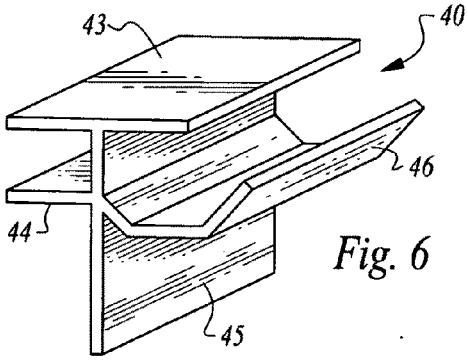
FIG. 6 is a perspective view of that which is shown in FIG. 5.
Figure 7:
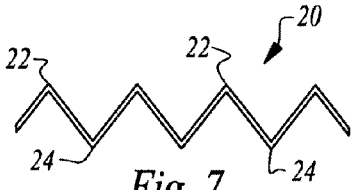
FIG. 7 is a sectional view of a portion of fine mesh material making up a portion of the system of this invention and revealing a preferred geometric configuration of the corrugated mesh material.
Figure 8:
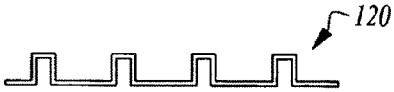
FIGS. 8-13 are alternative embodiments of the corrugated mesh material of FIG. 7 showing various different alternative embodiment corrugation configurations for the mesh material.
Figure 9:
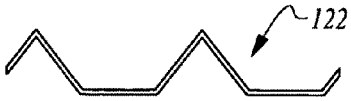
Figure 10:
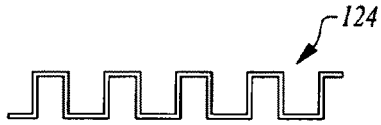
Figure 11:
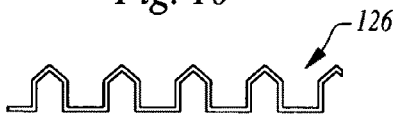
Figure 12:
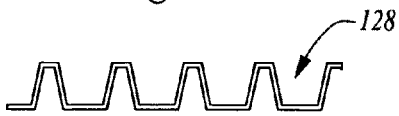
Figure 13:
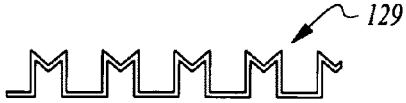

This lower strip 40, 140 can have a variety of different configurations, such as those depicted in FIGS. 3-6. In a most preferred form of the invention, the lower strip 40 is configured as depicted in FIGS. 5 and 6. This configuration includes a stop plate 45 extending substantially perpendicular to a plane in which the corrugated mesh 20 resides. The upper plate 43 is oriented perpendicular to this stop plate 45 and extending to either side of the stop plate 45. A lower plate 44 extends perpendicularly from one side of the stop plate 45 closest to the corrugated mesh 20. A recess 42 is thus defined between the upper plate 43 and lower plate 44.

The distance between the lower plate 44 and upper plate 43 preferably is similar to an amplitude of the corrugated mesh 20, or slightly less. Thus, the lower edge 28 of the corrugated mesh 20 can fit securely within the recess 42. Optionally, some form of adhesive or other fastener can be utilized to further secure the lower edge 28 of the corrugated mesh 20 within the recess 42. If fasteners are utilized, such fasteners could include staples, screws, rivets, pins, wire, clamps or other equivalent fastening means. If desired; holes can be provided in the lower plate 44 to prevent the recess 42 from becoming a reservoir for pooling of water therein.

As water runs down over the corrugated mesh 20 (along arrow A of FIG. 2) the water will tend to angle down (along arrow B of FIG. 17) and follow the troughs 24. When these troughs reach the lower strip 40, this water will adhere to the lower plate 44 and then to a lower portion of the stop plate 45. With this efficient water collecting at a lower end of the stop plate 45, the water will release from the stop plate 45 as droplets D and fall (along arrow E of FIG. 2) down into the gutter G.

Most preferably, a clamp plate 46 is provided generally opposite the lower plate 44 and extending generally laterally from the stop plate 45. This clamp plate 46 preferably is somewhat resilient and has a curving form generally matching a form of a typical lip L on a gutter G. The clamp plate 46 could have a variety of different configurations to accommodate lips L of different configurations. The clamp plate 46 is spaced from the upper plate 43 by a distance that causes the clamp plate 46 to flex slightly away from the upper plate 43 when pressed against the lip L of the gutter G and then snap toward the upper plate 43 to a closed position held to the lip L of the gutter G, and positioning the entire system 10 in the desired position over the gutter G and spanning from the lip L up to the roof R below the shingles S.

The upper plate 43 also provides the location where a fastener can be utilized to further secure the lower strip 40 to the gutter G. For instance, screws can pass through the upper plate 43 and then into the lip L to secure the system 10 in position on the gutter G. In addition, or alternatively, an adhesive can be utilized or some other form of fastener such as a rivet, nail, staple, pin or other lip L fastening means.

With particular reference to FIGS. 14 and 15, details of the upper strip 30 are described, according to an alternative embodiment where the system 10 includes the upper strip 30. When the upper strip 30 is provided as a preferred form of upper support for the upper edge 26 of the corrugated mesh 20 of the system 10, other portions of the system 10 remain the same. This upper strip 30 provides a thinner structure to fit beneath the shingles S and above the moisture barrier M, or above other underlying plywood P or other sheeting material for the roof R, so that water is effectively directed off of the shingles S and onto the corrugated mesh 20 of the system 10, rather than otherwise migrating under the mesh 20.

This upper strip 30 most preferably is a rigid structure formed of an extrudable material such as aluminum which has a constant cross-section to make it suitable for extrusion. Alternatively, the upper strip 30 can be formed in some other manner and from other materials such as plastics.

The upper strip 30 preferably includes a pocket 32 sized to receive the upper edge 26 therein. Thus, the pocket 32 preferably has a height between a lower leg 34 and upper leg 35 which is similar in height to the amplitude between the crests 22 and troughs 24 of the corrugated mesh 20. A tab 36 extends away from the pocket 32 in a direction opposite the corrugated mesh 20. This tab 36 is preferably substantially planar and in a plane aligned with that of the corrugated mesh 20.

As an alternative, the tab 36 could be bendable or preconfigured with a bend relative to the plane in which the corrugated mesh 20 is configured. For instance, to accommodate different pitches of roofs, the tab 36 could either be bendable or pre-bent to an angle matching the pitch of the roof with which the system 10 is to be installed. If such a bend were provided this bend could be directly adjacent the pocket 32 or could be spaced further from the pocket 32 depending on the width of the gutter G and other particular geometric characteristics of the roof R adjacent the fascia F.

While the lower strip 40 is preferably provided as a unitary mass, it could be formed of separate parts that are then attached together. The pocket 32 is preferably sized so that the upper edge 26 of the corrugated mesh 20 fits by friction therein. Alternatively, fasteners can be provided or an adhesive to secure the upper edge 26 within the pocket 32. Options for such fastening means are similar to those described above with respect to holding the lower edge 28 of the corrugated mesh 20 within the recess 42 of the lower strip 40.

Figure 16:
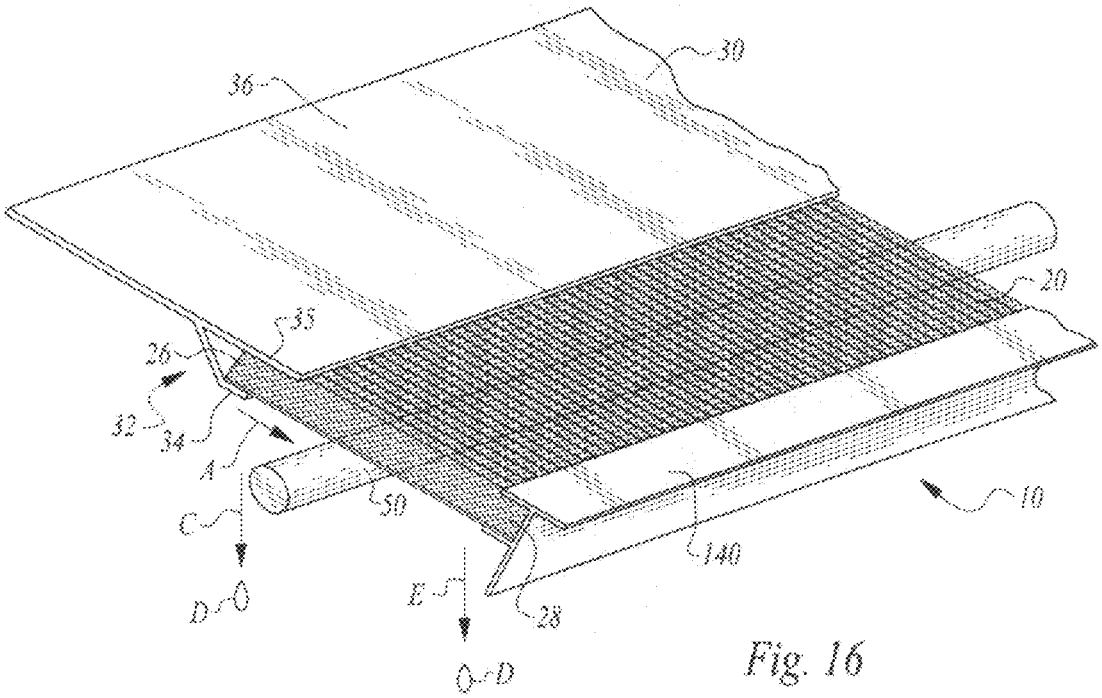
FIG. 16 is a perspective view of the debris preclusion system shown in FIGS. 14 and 15, with the addition of a barrier, such as in the form of a bead of caulk bonded to a lower portion of the corrugated mesh of the debris preclusion system to encourage water dropping off of the corrugated mesh material at a intermediate location.
Figure 17:
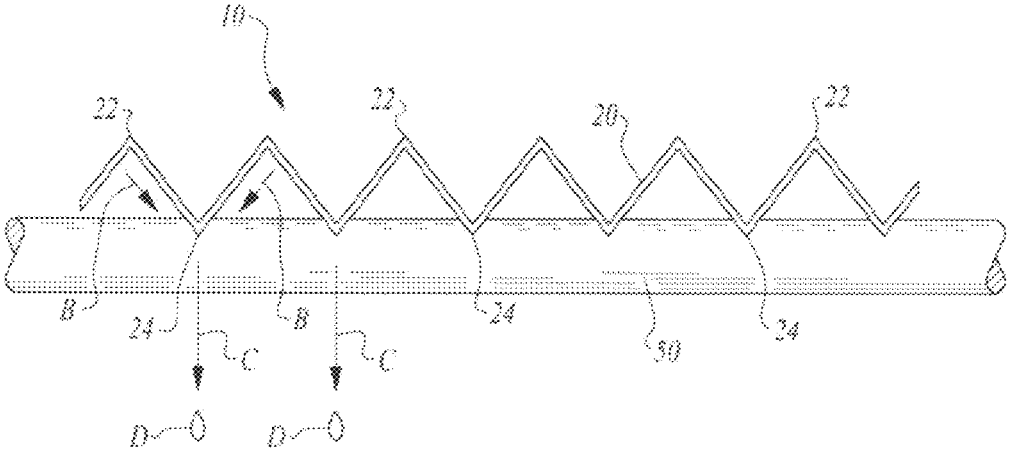
FIG. 17 is a sectional view of a portion of that which is shown in FIG. 16 illustrating further details of how the barrier can draw water off of the mesh material and cause it to fall down into the gutter.

With particular reference to FIGS. 16 and 17 details of an alternative embodiment are disclosed where a bead 50 is provided as a preferred form of barrier at a midpoint on the corrugated mesh 20 between the upper edge 26 and lower edge 28. This bead 50 is preferably a bead of caulk which acts as a preferred form of barrier which is applied wet and then hardens and simultaneously adheres to the lower surface of the corrugated mesh 20. In such a configuration, the bead 50 primarily only is bonded to the troughs 24 and portions of the corrugated mesh 20 adjacent the troughs 24, rather than covering an entire undersurface of the corrugated mesh 20. However, as most of the water travels along the trough 24 from the upper edge 26 toward the lower edge 28, this water impacts the bead 50 or other barrier.

The water initially follows planar portions of the corrugated mesh 20 between the crests 22 and the troughs 24 (along arrow B of FIG. 17) before following along the troughs 24 from the upper edge 26 toward the lower edge 28 (along arrow A of FIG. 16). By adhesion, the water wraps around this bead 50 and then collects on a lower surface thereof. When the weight of the water is sufficient, it forms droplets D which then fall off of the bead 50 (along arrow C of FIGS. 16 and 17). In this way, the water does not only fall of the lower strip 50, but also off of the bead 50, so that higher volumes of water flow can be effectively routed through the corrugated mesh 20 and down into the gutter G. While such water flows are rare, it is important that the gutter G can effectively perform when such heavy downpours occur so that the gutters G can perform to their full design capacity. With the bead 50 or other barrier such performance is optimized.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A leaf preclusion system for a roof gutter having a gutter lip for keeping leaves and other debris out of the roof gutter while allowing water to pass thereinto, comprising: a sheet of fine mesh material; said sheet of fine mesh material having an upper edge adapted to be located above a lower edge and with said sheet of fine mesh material overlying the roof gutter; said sheet of fine mesh material being corrugated with ridges extending at least part of the way from said upper edge to said lower edge and wherein said lower edge being adjacent the gutter lip when the system is in use, wherein the water is allowed to pass through said sheet of fine mesh material into the roof gutter, wherein at least one of said ridges extends from at least one of said upper edge and said lower edge.

2. The system of claim 1 wherein said ridges of said sheet of fine mesh material extend substantially perpendicular to said upper edge of said sheet of fine mesh material.

3. The system of claim 2 wherein said upper edge and said lower edge of said sheet of fine mesh material are oriented substantially parallel with each other.

4. The system of claim 1 wherein a lower support is provided adjacent said lower edge of said sheet of fine mesh material, said lower support including a recess for receiving said lower edge of said sheet of fine mesh material therein, said lower support adapted to be coupled to a lip at a forward edge of the gutter.

5. The system of claim 4 wherein said lower support includes a stop, said stop oriented non-parallel with valleys in said sheet of fine mesh material located between said ridges.

6. The system of claim 5 wherein said lower support includes an upper plate, said upper plate coupled to said stop and oriented non-parallel with said stop, said upper plate configured to be located above and abutting the lip of the gutter to provide at least a portion of said coupling of said lower support to the lip of the gutter, said upper plate defining a portion of said recess, said recess also defined by a lower plate spaced below said upper plate by a distance substantially matching a thickness of said fine mesh material between said ridges and said valleys.

7. The system of claim 6 wherein said lower support includes a clamp plate spaced below said upper plate and on a side of said stop opposite said recess, said clamp plate spaced from said upper plate by a distance similar to a thickness of a lip of a gutter, said clamp plate adapted to flex and grip said lip of said gutter when the lip of the gutter is located between said upper plate and said clamp plate.

8. The system of claim 1 wherein a barrier is located adjacent an underside of said sheet of fine mesh material and abutting valleys between said ridges in said sheet of fine mesh material.

9. The system of claim 8 wherein said barrier extends substantially parallel with said upper edge and spaced from said upper edge and said lower edge.

10. The system of claim 9 wherein said barrier includes a bead of caulk bonded to said sheet of fine mesh material.

11. The system of claim 1 including an upper support, said upper support having a pocket coupled to said upper edge of said sheet of fine mesh material with said upper edge of said sheet of fine mesh material located within said pocket, at least a portion of said upper support adapted to fit beneath lowermost shingles of the roof upon which the roof gutter is located.

12. The system of claim 11 wherein said pocket of said upper support includes a lower leg spaced from an upper leg by a distance similar to a distance between said ridges of said sheet of fine mesh material and valleys located between said ridges.

13. The system of claim 11 wherein said upper support includes a tab extending substantially coplanar with said sheet of fine mesh material and away from said sheet of fine mesh material, said tab adapted to reside between shingles and a moisture barrier upon the roof to which the roof gutter is attached, said tab adapted to route water onto said sheet of fine mesh material for passage therethrough and into said gutter.

14. A leaf preclusion system for a roof gutter having a gutter lip for keeping leaves and other debris out of the roof gutter while allowing water to pass thereinto, comprising: a sheet of fine mesh material; said sheet of fine mesh material having an upper edge adapted to be located above a lower edge and with said sheet of fine mesh material overlying the roof gutter; said sheet of fine mesh material being corrugated with ridges extending at least part of the way from said upper edge to said lower edge and wherein said lower edge being adjacent the gutter lip when the system is in use, wherein the water is allowed to pass through said sheet of fine mesh material into the roof gutter, wherein a lower support is provided adjacent said lower edge of said sheet of fine mesh material, said lower support including a recess for receiving said lower edge of said sheet of fine mesh material therein, said lower support adapted to be coupled to a lip at a forward edge of the gutter, wherein said lower support includes a stop, said stop oriented non-parallel with valleys in said sheet of fine mesh material located between said ridges, wherein said lower support includes an upper plate, said upper plate coupled to said stop and oriented non-parallel with said stop, said upper plate configured to be located above and abutting the lip of the gutter to provide at least a portion of said coupling of said lower support to the lip of the gutter, said upper plate defining a portion of said recess, said recess also defined by a lower plate spaced below said upper plate by a distance substantially matching a thickness of said fine mesh material between said ridges and said valleys, wherein said lower support includes a clamp plate spaced below said upper plate and on a side of said stop opposite said recess, said clamp plate spaced from said upper plate by a distance similar to a thickness of a lip of a gutter, said clamp plate adapted to flex and grip said lip of said gutter when the lip of the gutter is located between said upper plate and said clamp plate and, wherein said sheet of fine mesh material is configured to be substantially flat between pointed ridges and pointed valleys.

15. The system of claim 14 wherein said sheet of fine mesh material is formed of stainless steel wire woven together with some of said wire running substantially parallel with said upper edge and some of said wire running substantially parallel with said upper edge.

16. A method for keeping leaves and other debris out of a roof gutter while allowing water to pass thereinto, including the steps of: providing a sheet of fine mesh material, the sheet of fine mesh material having an upper edge adapted to be located above a lower edge, the sheet of fine mesh material being corrugated with ridges extending at least part of the way from the upper edge to the lower edge; and locating the sheet of fine mesh material over a gutter with ridges running toward a lip of the gutter, wherein the water is allowed to pass through said sheet of fine mesh material into the roof gutter and wherein at least one of said ridges extends from at least one of said upper edge and said lower edge.

17. The method of claim 16 including the further step of angling the sheet of fine mesh material to slope downward as the ridges run toward the lip of the gutter.

18. The method of claim 17 including the further step of positioning the upper edge of the sheet of fine mesh material beneath shingles and over structural material forming the roof.

19. The method of claim 16 including the further step of providing an upper support adapted to be coupled to the sheet of fine mesh material, the upper support including a tab extending away from the sheet of fine mesh material and substantially coplanar with the sheet of fine mesh material; and positioning the tab of the upper support beneath shingles on the roof and above structural material forming the roof.

20. The method of claim 16 including the further steps of: providing a lower support, the lower support including a recess locating the lower edge of the sheet of fine mesh material within the recess; and positioning the lower support upon a lip at a front edge of the gutter.

21. The method of claim 20 wherein said providing a lower support step includes the step of providing the lower support with a stop plate, said stop plate oriented non-parallel with the ridges of the sheet of fine mesh material, said stop adapted to route water down into the gutter when water clinging to the sheet of fine mesh material impacts the stop adjacent the lower edge of the sheet of fine mesh material.

22. The method of claim 21 wherein said providing a lower support step includes configuring the lower support to include a clamp on a side of the stop opposite the sheet of fine mesh material, the clamp adapted to snap onto and off of the lip at the front edge of the gutter.

23. The method of claim 16 including the further step of locating a barrier adjacent an underside of the sheet of fine mesh material, the barrier tending to impede flow of water clinging to an underside of the sheet of fine mesh material and cause the water to release as drops from the barrier.

* * * * *